US007562874B1

(12) United States Patent
White

(10) Patent No.: US 7,562,874 B1
(45) Date of Patent: Jul. 21, 2009

(54) BOARD GAME AND METHOD FOR PLAYING THE BOARD GAME

(76) Inventor: Lawrence L. White, 4205 S. Dees Dr., Oklahoma City, OK (US) 73150-2507

( * ) Notice: Subject to any disclaimer, the term of this patent is extended or adjusted under 35 U.S.C. 154(b) by 95 days.

(21) Appl. No.: 11/294,831

(22) Filed: Dec. 7, 2005

(51) Int. Cl.
*A63F 3/00* (2006.01)

(52) U.S. Cl. ..... 273/243; 273/242

(58) Field of Classification Search ..... 273/242, 273/243, 262
See application file for complete search history.

(56) References Cited

U.S. PATENT DOCUMENTS 4,640,513 A 2/1987 Montijo
4,784,394 A 11/1988 Sumin
4,907,808 A 3/1990 Turner et al.
4,966,372 A 10/1990 Robison
5,445,389 A 8/1995 Jeffreyes, Jr.
D408,867 S 4/1999 Tompkins
6,139,016 A * 10/2000 Plato ..... 273/242
6,623,008 B1 * 9/2003 Reed et al. ..... 273/242

* cited by examiner

*Primary Examiner*—Vishu K. Mendiratta

(57) ABSTRACT

A method of playing the board game includes an annular board game that has a planar top surface provided with indentations that intersect at a center of the board such that the board is divided into four quadrants. Annular and square recesses are created in each quadrant. The annular recesses are aligned along an outer perimeter of the board and the square recesses are aligned along a equatorial axis thereof. The annular and square recesses are coextensively shaped. A first deck of cards is provided, wherein each card has a unique color and an emotion displayed thereon. A second deck of cards is provided, wherein each card has text written thereon which narrates a romance and a drama scene. Game pieces are provided that have annular base portions and cylindrical top portions. Each top portion has a linear slit formed therein. Photographic cards are removably interfittable into the slits.

1 Claim, 2 Drawing Sheets

BOARD GAME AND METHOD FOR PLAYING THE BOARD GAME

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to board games and, more particularly, to a board game and a method for playing the board game.

2. Prior Art

Many families, as well as groups of friends, enjoy socializing while being engaged in a board game of some sort. Board games have provided such an entertainment outlet for many years, thus it is not surprising that the prior art has many examples of board games, each taking various approaches to their method of play. Various studies have shown that playing board games is beneficial to one's social development, and in the case of families, provides an opportune time for parents to interact with their children and to be involved in their developmental years.

It is thus important to allow as many persons as possible to be involved in the board game. Unfortunately, many games of this type are limited in the sense that only two to eight people are allowed to play at any one time. In larger families and certain social settings, with many attendees, this would mean that some persons must be excluded from the activity, which is not desirable. When families are playing a board game it also becomes vital for the game to be entertaining across a broad age range so that parents and their children are simultaneously sufficiently stimulated, such that interest is not quickly lost. Board games also strive to remain novel and entertaining, even through repeated rounds of play. Unfortunately, many board games are limited in this sense, since the method of play does not allow for much elaboration and the persons who play quickly become uninterested with the game.

Accordingly, a need remains for a board game and a method for playing the board game in order to overcome the above-noted shortcomings. The present invention satisfies such a need by providing a board game that is entertaining to play, has a wide age range appeal, allows up to 24 people to play at any one time, is light weight for easy transport and finds particular appeal among soap opera enthusiasts. Such a board game provides an entertaining game for parties and for the family that allows individuals to enjoy the thrill of watching a plot unfold before their eyes. The rules are simple and easy to learn, thereby allowing persons of all ages to participate and enjoy the game.

BRIEF SUMMARY OF THE INVENTION

In view of the foregoing background, it is therefore an object of the present invention to provide a board game and a method for playing the board game. These and other objects, features, and advantages of the invention are provided by a method of playing a board game that simulates romance drama story lines.

The method of playing the board game includes providing an annular board game that has a planar top surface provided with a plurality of indentations defining lines of weaknesses respectively. Such indentations intersect at a center of the board game and are oriented orthogonal to each other such that the board game is effectively divided into four quadrants. A plurality of annular and square recesses are created in each of the quadrants respectively. Such annular and square recesses are juxtaposed along a symmetric pattern according to a shape thereof such that the annular recesses are aligned along an outer perimeter of the game board and the square recesses are aligned along a equatorial axis of the game board respectively. The annular recesses are coextensively shaped, and the square recesses are coextensively shaped and equally distributed within the four quadrants.

A first deck of cards are provided. Each card of the first deck of cards has a unique color and an associated emotion displayed thereon. A second deck of cards are provided. Each card of the second deck of cards has text written thereon which narrates one of a romance scene and a drama scene from a soap opera. A plurality of game pieces are provided that have annular base portions and cylindrical top portions monolithically formed therewith respectively. Each top portion is provided with a linear slit registered along a central axis thereof. A plurality of photographic cards are provided that are removably interfittable into the slits. Each one of the photographic cards depicts an image of a real-life soap opera cast member such that players of the game can role-play with alternate soap opera cast members during each round of play.

The method preferably further includes the steps of positioning first and second groups of the game pieces at first and second hemispheres of the game board. Such first and second groups of the game pieces have an equal number of players associated therewith. Next, a player randomly moves one of the game pieces from the first group of game pieces from one of the annular recesses to one of the square recesses and chooses one of the game pieces from the second group of game pieces that is directly opposite of the one game piece of the first group of game pieces. Then another participant moves the one second group game piece from another one of the annular recesses to another one of the square recesses. Such another square recess and the one recess are located directly opposite each other and are equilaterally spaced from the equatorial axis.

The method may further include the steps of instructing each player associated with the one game piece of the first and second group of game pieces to draw a top one of the first deck of cards and to determine whether the top ones of the first deck of cards have the same color and emotion displayed thereon. If the top ones of the first deck of cards are equal the players then draws a top one of the second deck of cards and reads the narrative written thereon. Finally, the players return their one game piece from the first and second group of game pieces to an original position and repeat all the steps until all the first deck of cards have been selected and a narrative story line has been acted out.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
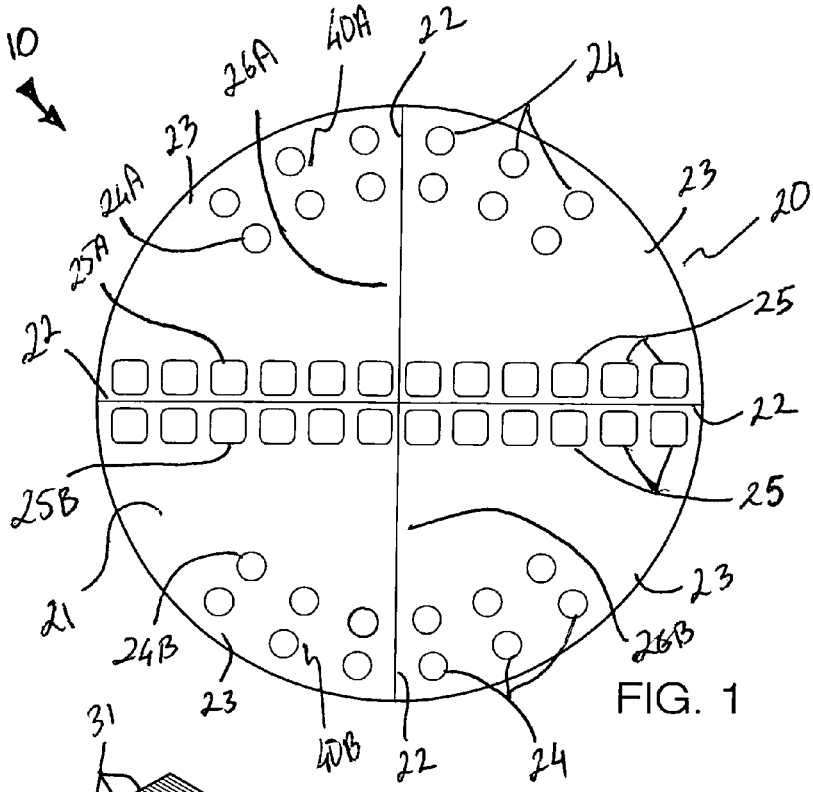
FIG. 1 is a top plan view showing a board game that simulates romance drama story lines, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The method of this invention is referred to generally in FIGS. 1-4 by the reference numeral 10 and is intended to provide a board game and a method for playing the board game. It should be understood that the method 10 may be used to play many different types of story lines and should not be limited in use to only romantic, soap opera like story lines.

Referring initially to FIG. 1, the method 10 includes an annular board game 20 that has a planar top surface 21 provided with a plurality of indentations 22 defining lines of weaknesses respectively. Of course, the board game 20 may be produced in a variety of alternate shapes and sizes, as is obvious to a person of ordinary skill in the art. Such indentations 22 intersect at a center of the board game 20 and are oriented orthogonal to each other such that the board game 20 is effectively divided into four quadrants 23. A plurality of annular 24 and square 25 recesses are created in each of the quadrants 23 respectively. Of course, the recesses 24, 25 may be produced in a variety of alternate shapes, as is obvious to a person of ordinary skill in the art.

Such annular 24 and square 25 recesses are juxtaposed along a symmetric pattern according to a shape thereof such that the annular recesses 24 are aligned along an outer perimeter of the game board 20 and the square recesses 25 are aligned along an equatorial axis of the game board 20 respectively. The annular recesses 24 are coextensively shaped, and the square recesses 25 are coextensively shaped and equally distributed within the four quadrants 23. There are a total of 24 square recesses 25 and annular 24 recesses, allowing for a total of 24 possible players participating in the game board 20 activities.

Figure 2:
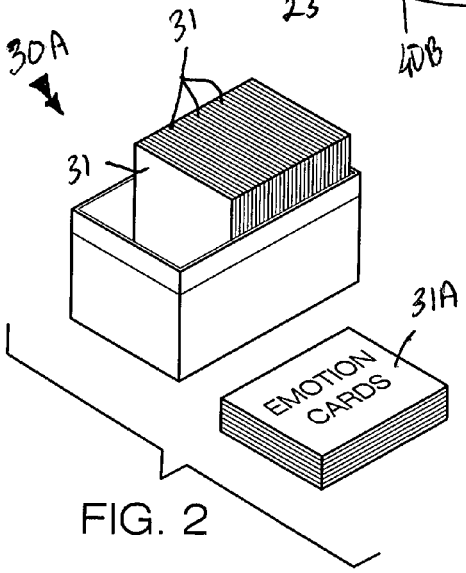
FIG. 2 is a perspective view showing a first deck of cards, in accordance with the present invention.
Figure 3:
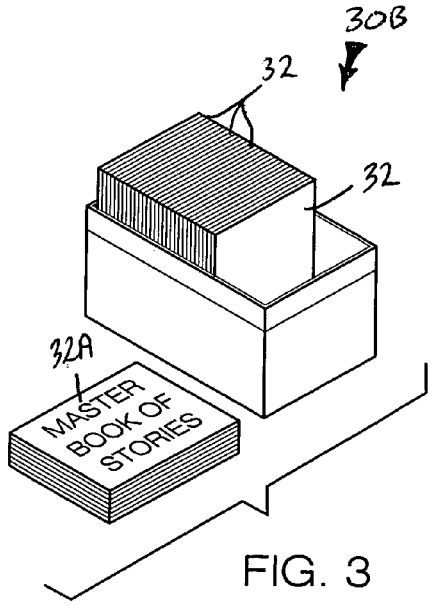
FIG. 3 is a perspective view showing a second deck of cards, in accordance with the present invention.

Referring to FIGS. 2 and 3, a first deck of cards 30A are provided. Each card 31 of the first deck of cards 30A has a unique color and an associated emotion displayed thereon. A second deck of cards 30B are provided. Each card 32 of the second deck of cards 30B has text written thereon which narrates one of a romance scene and a drama scene from a soap opera. Of course, the cards 32 of the second deck of cards 30B may narrate a dramatic scene from a variety of genres and not just romance soap opera scenes, as is obvious to a person of ordinary skill in the art.

Figure 4:
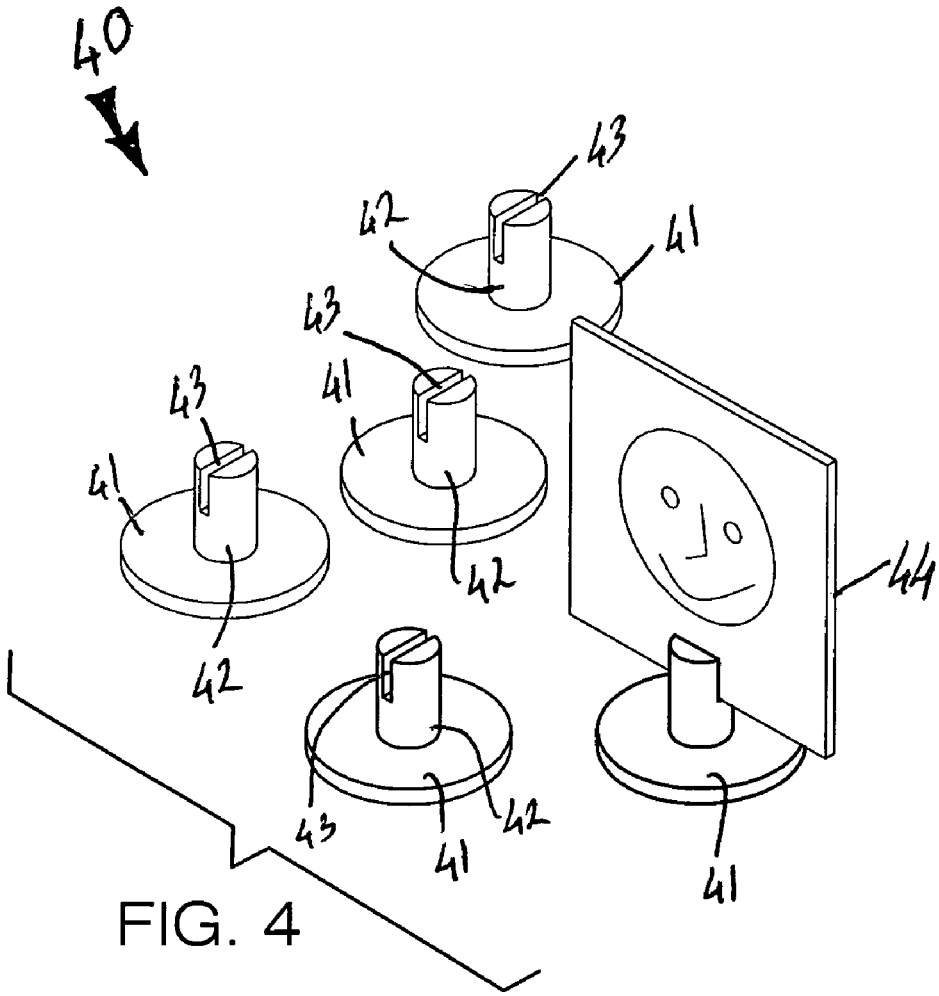
FIG. 4 is a perspective view showing a plurality of game pieces, in accordance with the present invention.

Referring to FIG. 4, a plurality of game pieces 40 are provided that have annular base portions 41 and cylindrical top portions 42 monolithically formed therewith respectively. Of course, the game pieces 40 may be produced in a variety of different shapes, sizes and colors, as is obvious to a person of ordinary skill in the art. Each top portion 42 is provided with a linear slit 43 registered along a central axis thereof. A plurality of photographic cards 44 are provided that are removably interfittable into the slits 43. Each one of the photographic cards 44 depicts an image of a real-life soap opera cast member such that players of the game can role-play with alternate soap opera cast members during each round of play. Alternately, the players can place photos of themselves in the slits 43 to add a fun and new dimension to the game board 20.

Referring to FIGS. 1 and 4, the method 10 further includes the steps of positioning first 40A and second 40B groups of the game pieces 40 at first 26A and second 26B hemispheres of the game board 20. Such first 40A and second 40B groups of the game pieces 40 have an equal number of players associated therewith. Next, a player randomly moves one of the game pieces 40 from the first group of game pieces 40A from one of the annular recesses 24A to one of the square recesses 25A and chooses one of the game pieces 40 from the second group of game pieces 40B that is directly opposite of the one game piece 40 of the first group of game pieces 40A. Then another participant moves one of the second group game pieces 40B from another one of the annular recesses 24B to another one of the square recesses 25B. Such another square recess 25B and the one square recess 25A are located directly opposite each other and are equilaterally spaced from the equatorial axis, as is best shown in FIG. 1.

Referring to FIGS. 2, 3 and 4, The method also includes the steps of instructing each player associated with the one game piece 40 of the first 40A and second 40B group of game pieces to draw a top one 31A of the first deck of cards 30A and to determine whether the top ones 31A of the first deck of cards 30A have the same color and emotion displayed thereon. If the top ones 31A of the first deck of cards 30A are equal the players then draws a top one 32A of the second deck of cards 30B and reads the narrative written thereon.

Finally, the players return their one game piece 40 from the first 40A and second 40B group of game pieces to an original position and repeat all the steps until all the first deck of cards 30A have been selected and a narrative story line has been acted out. Since the placement of the game pieces 40 and the drawing of cards 31, 32 are random and independent events, advantageously a virtually limitless number of possible story lines can be created during consecutive games. Thus, the method 10 always results in a new and unique story line that will keep all the players interested in playing the game board 20 repeatedly, without becoming bored.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A method of playing a board game that simulates romance drama story lines, said method of playing the board game being executed by players of the game, said method of playing the board game comprising:

a. providing an annular board game having a planar top surface provided with a plurality of indentations defining lines of weaknesses respectively, said indentations intersecting at a center of said board game and being oriented orthogonal to each other such that said board game is divided into four quadrants;

b. creating a plurality of annular and square recesses in each, said quadrants respectively, said annular and square recesses being juxtaposed along a symmetric pattern according to a shape thereof such that said annular recesses are aligned along an outer perimeter of said game board and said square recesses are aligned along a equatorial axis of said game board respectively, wherein said annular recesses are coextensively shaped, wherein said square recesses are coextensively shaped and equally distributed within said four quadrants;

c. providing a first deck of cards, each said first deck of cards having a unique color and associated emotion displayed thereon;

d. providing a second deck of cards, each said second deck of cards having text written thereon which narrates one of a romance scene and a drama scene from a soap opera;

e. providing a plurality of game pieces having annular base portions and cylindrical top portions monolithically formed therewith respectively, each said top portions being provided with a linear slit registered along a central axis thereof;

f. providing a plurality of photographic cards removably interfittable into said slits, each said photographic cards depicting an image of a real-life soap opera cast member such that players of the game role-play with alternate soap opera cast members during each round of play;

g. positioning first and second groups of said game pieces at first and second hemispheres of said game board, said first and second group of said game pieces having an equal number of players associated therewith;

h. randomly moving one said game pieces from said first group of game pieces from one said annular recesses to one said square recesses;

i. choosing one said game pieces from said second group of game pieces that is directly opposite of said one game piece of said first group of game pieces;

j. moving said one second group game piece from another said annular recesses to another said square recesses, said another square recess and said one recess being located directly opposite each other and equilaterally spaced from said equatorial axis;

k. instructing each said players associated with said one game pieces of said first and second group of game pieces to draw a top one of said first deck of cards;

l. determining whether said top ones of said first deck of cards have the same color and emotion displayed thereon;

m. if said top ones of said first deck of cards are equal, then drawing a top one of said second deck of cards and reading the narrative written thereon;

n. each said players acting out the narrative according to the emotion displayed on said top ones of said first deck of cards respectively;

o. returning said one game pieces from said first and second group of game pieces to an original position; and p. repeating steps a.-o. until all said first deck of cards have been selected and a narrative story line has been acted out.

* * * * *